US006125751A

United States Patent [19]

Korem

[11] Patent Number: 6,125,751

[45] Date of Patent: Oct. 3, 2000

[54] ECONOMICAL DUPLEX WEB PRINTING PRESS

[75] Inventor: Aharon Korem, Herzlia, Israel

[73] Assignee: Scitex Corporation Ltd., Herzlia, Israel

[21] Appl. No.: 09/109,727

[22] Filed: Jul. 2, 1998

[30] Foreign Application Priority Data

Aug. 18, 1997 [IL] Israel ..... 121564

[51] Int. Cl.[7] ..... B41F 5/16

[52] U.S. Cl. ..... 101/180; 101/223

[58] Field of Search ..... 101/179, 180, 101/220, 221, 216, 225, 181, 183, 223, 230, 222

[56] References Cited

U.S. PATENT DOCUMENTS

| | | | |
|---|---|---|---|
| 324,986 | 8/1885 | Crowell | 101/220 |
| 4,286,519 | 9/1981 | Smith | 101/138 |
| 4,610,198 | 9/1986 | Raymond . | |
| 5,129,321 | 7/1992 | Fadner | 101/467 |
| 5,410,384 | 4/1995 | Wachtler . | |
| 5,467,179 | 11/1995 | Boeck et al. . | |

FOREIGN PATENT DOCUMENTS

| | | | |
|---|---|---|---|
| 2339323 | 8/1973 | Germany | 101/221 |

*Primary Examiner*—Ren Yan
*Attorney, Agent, or Firm*—Mark M. Friedman

[57] ABSTRACT

A duplex color web press, wherein each section, which prints both faces of the web with any one ink type and color, is configured with a single printing cylinder and, in the case of a digitally recording press, with a single recording head. The single printing cylinder carries the inking versions of both the recto and verso images around its circumference and the web is routed through two printing stations, both associated with the single printing cylinder, so that one of its faces is imprinted in one station and the other face—in the other station. The resultant print on each face is alternating recto and verso images, such that a recto image on one face is in the back of a verso image on the other face, and vice versa.

15 Claims, 5 Drawing Sheets

ECONOMICAL DUPLEX WEB PRINTING PRESS

FIELD AND BACKGROUND OF THE INVENTION

The present invention relates to a duplex web offset printing press and, more particularly, to such a press in which a digitally represented image is recorded onto the printing form while in its printing position.

In common with presses based on other printing methods, an offset printing press has one or more printing cylinders. On each printing cylinder is mounted a printing form—usually a lithographic plate, which carries an inking image. The latter is a representation of the image to be printed, in terms of the plate's surface property of either carrying or not carrying ink thereon, after passing an inking station (possibly following a wetting station). The imagewise distributed ink thus carried on the surface of the printing form after passing the inking station, which will also be referred to as the ink image or as the inked version of the image, is transferred to a blanket cylinder and thence—to the medium to be printed, thereby imprinting the medium. In presses with other printing methods, the inking image is represented by various mechanical properties of the printing form, such as depth of pits, in gravure, or salient surfaces, in flexography; also, in such presses, the inked version of the image is transferred from the printing form directly to the medium.

Offset printing presses in which the inking image is recorded onto the printing form, while the latter is mounted in the press in its printing position, are known and have recently come into general practice. In such a press, which will be termed herein Digital Offset Press (DOP), the printing form may be a cylinder, with a special surface, or a plate or foil wrapped around a cylinder. A lithographic inking image is recorded thereon by means of a recording head (RH) according to digital image data provided from a driving system. Any of a number of techniques may be utilized for recording the image; generally, energy is delivered from the RH, in a time varying manner, to a plurality of points on the form while the cylinder rotates. Often, the RH is based on an array of laser diodes, spanning a small part of the length of the cylinder, in which case usually the RH travels, parallel to the axis of the cylinder, to thus sequentially record successive strips around the cylinder. Another common technique is to optically scan one or more laser beams across the printing form in an axial direction, while the cylinder slowly rotates. Once an image has been recorded, the RH is set idle, while the printing form becomes actively involved in the printing process. As in a conventional press—cyclically being imagewise inked and transferring the ink image to a blanket roller. The blanket roller, in turn, transfers the ink image to the printed medium, such as a running web of paper, while the latter is pressed between the blanket and an impression cylinder. After completing a print run (that is—printing the desired number of copies, or impressions), the image on the print form is erased, or a new foil or layer is spread over it, and a new inking image is recorded, in the manner described above.

The main advantage of a DOP over a conventional offset press is that it takes considerably less time to thus record an image, ready for printing, than to mount a printing plate (which has been imaged and processed separately) on the print cylinder of the press and then (in a multi-color press) to adjust the relative positions of all plates so that their impressions register.

Like conventional presses, a DOP can be configured to print on discrete sheets or on a continuous web, in single color or in multiple ink colors and to print on one side of the paper (simplex) or on both sides of the paper (duplex) in any one print run. The present invention addresses duplex printing, whether in single- or multiple ink colors; while it is primarily designed for web printing and will be described for such a configuration, it is also applicable to sheet printing.

Generally, a duplex web press, depicted schematically in FIG. 1, has a pair of print stations for each ink color, each station consisting essentially of a printing form cylinder, an inking system, a blanket cylinder and an impression cylinder. The two stations of a pair are arranged so as to print opposite faces of the web, which are designated as "recto" and "verso", respectively. For color printing, as in the press of FIG. 1, there usually are four such pairs of print stations—for a total of eight stations. In a DOP that is configured like a conventional press, each station has, in addition, a recording head (RH), as described hereabove. Thus for four colors there will be eight recording heads. Now, in general, the cost of a RH, with its supporting mechanisms and control- and drive circuits, may be relatively high. Thus, eight RHs, required by such a configuration, may represent a considerable investment. Moreover, since a RH may be inherently limited in reliability, the deployment of eight recording heads may result in a severe reduction of reliability for the overall system.

It is the object of the present invention to reduce the number of required RHs to just one per pair of duplex print stations, in order to reduce costs and increase reliability; thus there will be one RH for a single color duplex press and four RHs—for a four-color duplex press.

U.S. Pat. No. 5,410,384 to Waechtler discloses an electrophotographic printing device, wherein a photoconducting drum is divided lengthwise into two cylindrical regions. On one region are recorded images intended for the recto face of the print medium, while on the other region are recorded those for the verso face. A pair of transfer ribbons is routed over a set of rollers so that each ribbon transfers toner from one region of the drum to the corresponding face of the print medium, the transfers to the print medium occurring at a single common station. Such an arrangement is not suitable for offset printing, where the transfer medium is generally a blanket cylinder, rather than a ribbon, and is obviously not applicable to any direct contact printing method, such as flexography, rotary screen or gravure.

There is thus a widely recognized need for, and it would be highly advantageous to have, a practical digital duplex web press, utilizing any printing method, that has only one recording head per print color.

SUMMARY OF THE INVENTION

The present invention successfully addresses the shortcomings of the presently known configurations by providing a duplex web press, wherein each section, which prints both faces of the web with any one ink type and color, is configured with a single printing cylinder and in the case of a digitally recording press, with a single recording head.

The present invention discloses a novel configuration of a press section in which the single printing cylinder carries the inking versions of both the recto and verso images around its circumference and in which the web is routed through two printing stations, both associated with the single printing cylinder, so that one of its faces is imprinted in one station and the other face—in the other station. The resultant print on each face is alternating recto and verso images, such that a recto image on one face is in the back of a verso image on the other face, and vice versa.

More specifically, in the exemplary case of a digital web offset press, each press section of the present invention includes one printing cylinder, whose surface serves as a lithographic printing form or as a base therefore. This surface is virtually divided around the circumference into two hemi-cylinders, one to carry the recto image and one—the verso image. Around the printing cylinder are disposed two sets of inking rollers and two blanket cylinders. In contact with each blanket cylinder is and impression cylinder, forming between them a printing station. Also disposed near the printing cylinder is a recording head, which is able to record an inking image on the entire surface of the printing form.

The web is routed, in sequence, through the first printing station, a web inverter and the second printing station, whence it proceeds to the first printing station of the next section, if any. The web inverter serves to rotate the web by 180 degrees about it longitudinal axis, so that when it reaches the second printing station, the face that comes in contact with the blanket cylinder is the opposite of that which faced the blanket cylinder in the first station.

In operation, both the recto and verso images are recorded on the printing form, within their respective hemi-cylinders, by feeding appropriately timed drive signals, corresponding to the two images, to the recording head. For printing, both inking systems are activated and the resultant inked images, alternating between recto and verso, are imprinted on each face of the web. The length of the web between the two stations is adjusted so that recto and verso images on both faces overlap in pairs.

The invention is advantageously applicable also to presses without recording facility and also to presses based on printing methods other than offset lithography. It is also applicable, with some modifications to sheetfed duplex presses.

According to the present invention there is provided a printing press section for multiply printing a recto and a verso image onto both faces of a medium with one type of ink, comprising

- a cylindrical printing form, which is virtually divided into two semi-cylindrical halves, one half to carry an inking image corresponding to the recto image and the other half to carry a inking image corresponding to the verso image,
- a first and a second impression station, each operative to repeatedly imprint a face of the medium with an inked version of both images carried by the printing form,
- a medium inverter, and
- means for transporting the medium, in sequence, through the first impression station, the medium inverter and the second impression station, so that a first face of the medium is imprinted at the first impression station and the second face of the medium is imprinted at the second impression station.

According to further features in preferred embodiments of the invention described below, the medium is formed as a web and the images imprinted on respective faces of the medium are positioned so that generally each recto image on one face is in essential overlap with a verso image on the other face.

According to still further features in the described preferred embodiments, wherein inking images are directly recordable on the printing form, the press section further comprises a recording head, operative to record inking images, corresponding to the recto and verso images, onto the printing form.

In one configuration of the invention, the printing method is offset lithography and the press section further comprises, in association with each of the impression stations, an inking system and a blanket cylinder, in contact with the printing form.

There is also disclosed a multi-color printing press for multiply printing a recto and a verso image onto both faces of a medium, comprising a plurality of sections in tandem, each section as described hereabove.

BRIEF DESCRTPTION OF THE DRAWINGS

The invention is herein described, by way of example only, with reference to the accompanying drawings, wherein.

DESCRIPTION OF THE PREFERRED EMBODIMENTS

The present invention is of a duplex offset printing press in which the lithographic inking image can be digitally recorded on printing forms mounted on the press.

Specifically, the present invention can be used to halve the number of recording heads and the number of printing cylinders required to print a pair of oppositely facing images. The present invention is applicable also to digital presses that use other printing methods, such as flexography, rotary screen and gravure and may be advantageously applied also to conventional duplex presses, that is—presses that use printing forms prepared off the press.

The principles and operation of a press according to the present invention may be better understood with reference to the drawings and the accompanying description.

Figure 1:
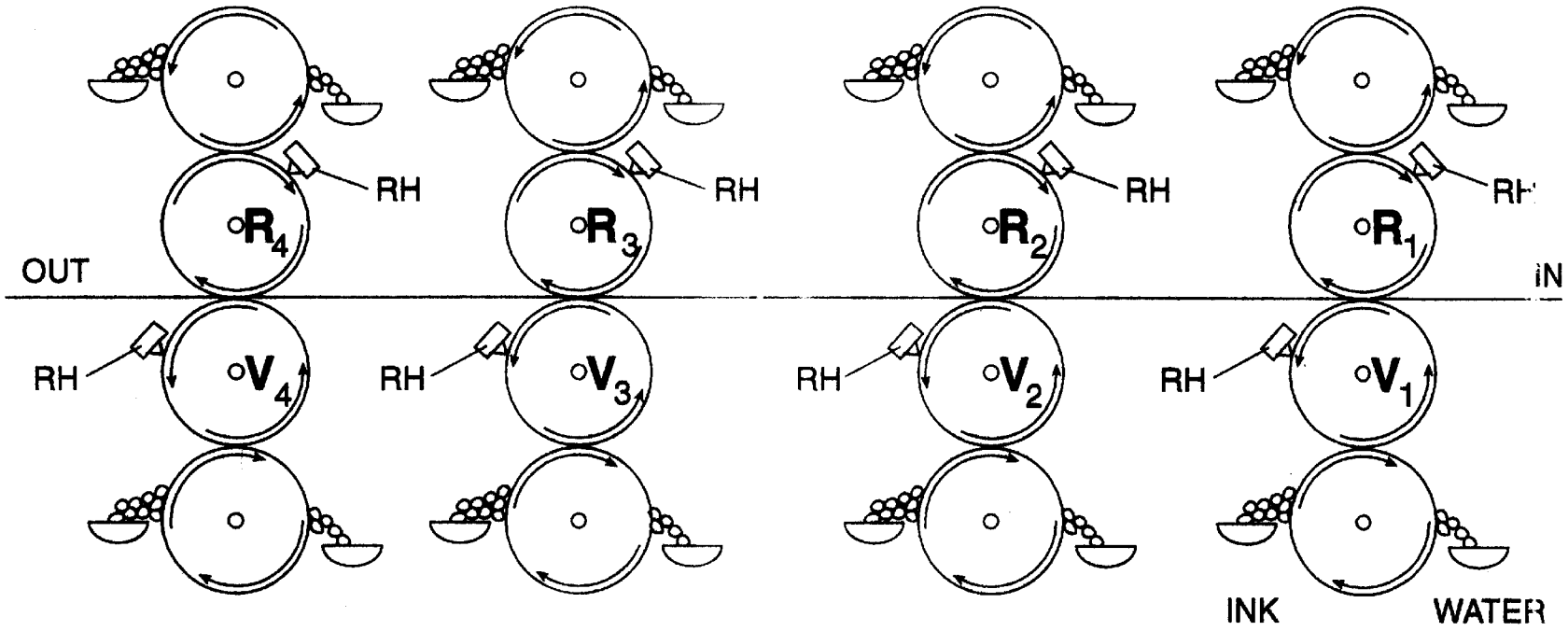
FIG. 1 PRIOR ART
FIG. 1 is a schematic cross-sectional view of a multi-color digital duplex web offset press according to prior art.
Figure 2A:
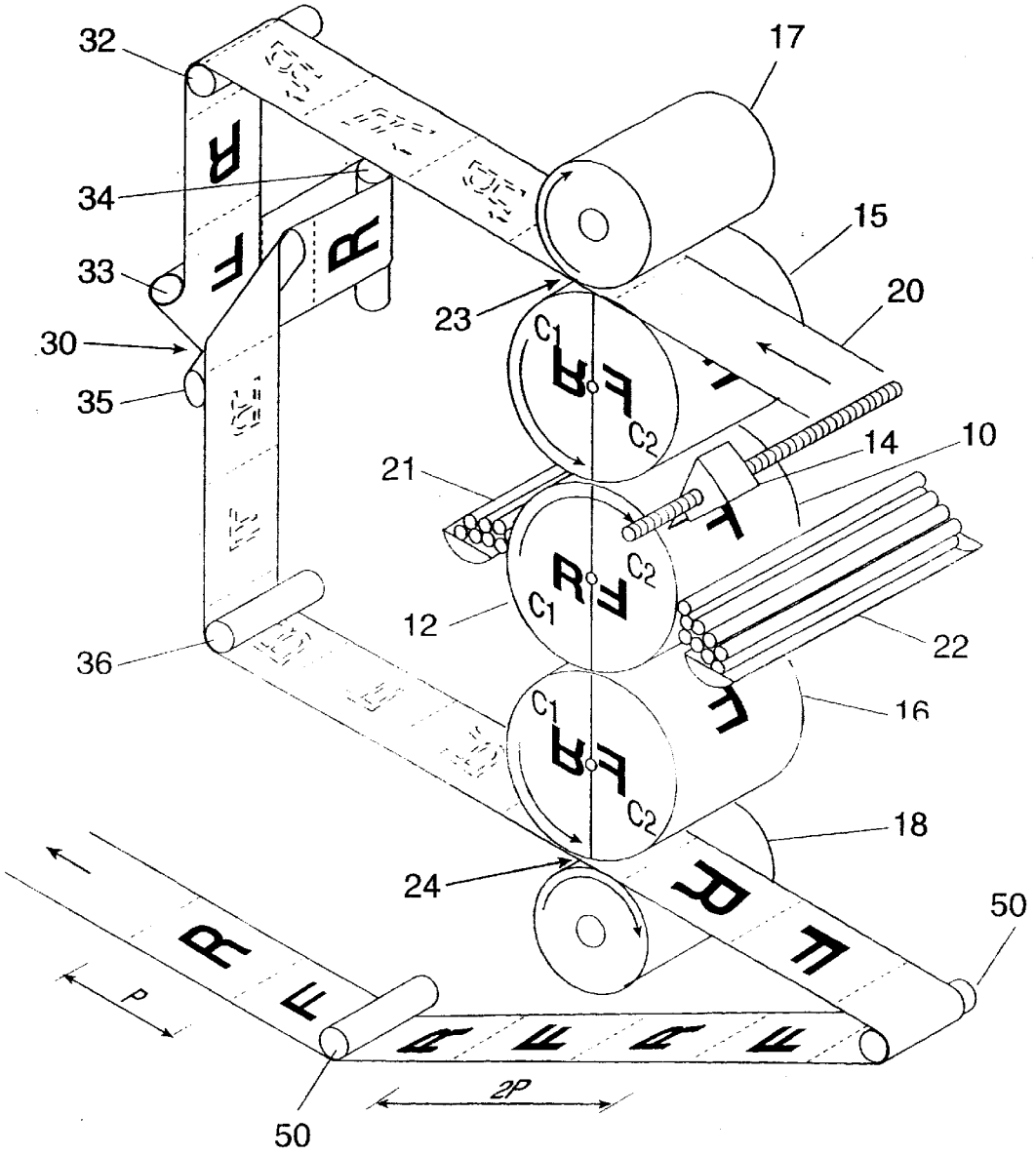
FIG. 2A is a schematic isometric view.
Figure 2B:
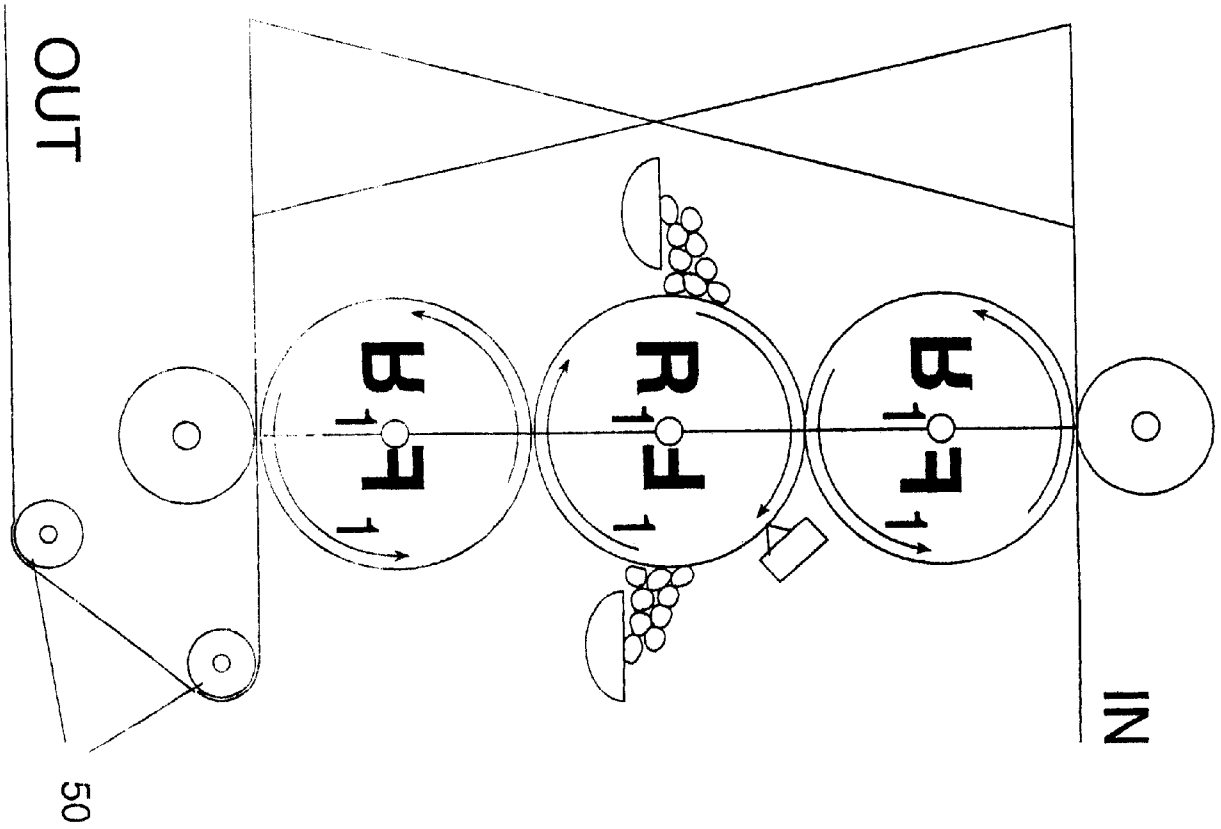
FIG. 2B is a schematic cross-sectional view, of a single color digital duplex web offset press according the present invention.

Referring now to the drawings, FIG. 2 illustrates a single color digital duplex web offset press (DDWOP), configured according to a preferred embodiment of the present invention, whereby FIG. 2A is a schematic isometric drawing and FIG. 2B is a schematic cross-sectional drawing of such a press. It is noted that these drawings also illustrate, in essence, a typical one-color section of a multi-color press, as will be more explicitly illustrated in FIGS. 3. Except as noted, the axes of all cylinders and rollers in this preferred embodiment are parallel and oriented horizontally.

In common with a conventional duplex web press, the DDWOP is designed to print on both faces of a web of print medium (e.g. paper) a multiplicity of impressions of a pair of images, to be termed recto (front, also referred to as F) and verso (back, or rear, also referred to as R), respectively, each corresponding pair of impressions lying on opposite faces of the web in essentially total overlap. Successive impressions start at points along the web that are a distance P apart (that is—the pitch of the impressions is P) and thus the maximum length of each image (as measured along the web) is P. It is noted that in a conventional web press, P is also the circumference of the printing cylinder. Also in common with a conventional duplex web press, the web, after being imprinted in the press, is usually cut into sheets of length P, each sheet thus retaining one pair of impressions—a recto impression on one face and a verso impression on the other face.

There is shown in FIGS. 2A and 2B a printing cylinder 10, a substantial portion of whose cylindrical surface 12 serves either as the printing form itself or as a basis for a printing form (such as a plate or a foil); in the description that follows, the first possibility will be assumed without loss of generality. The printing form is preferably of the waterless lithography type, but any other type is also usable.

In proximity to surface 12 there is disposed a recording head (RH) 14 so that it can record an inking image on the entire printing form portion of surface 12, according to signals supplied to it from a drive circuit (not shown). The printing form and the recording head may be consistent with any technique for recording a lithographic inking image. One known technique, which is applicable in conjunction with the present invention, involves an imagewise ablation of a thin layer of material by means of an energetic IR laser beam, as disclosed, for example in U.S. Pat. No. 5,570,636. Plates utilizing such a technique are available from Presstek, 8 Commercial St., Hudson, N.H. 03051, under the trade name Presstek Pearl Dry. For some techniques, there may be one or more additional devices disposed in proximity to surface 12—to serve for auxiliary functions, such as preparing the printing form for recording, developing the recorded image (or removing excess material) and erasing the image after a print run; all such additional devices will be understood to be associated with RH 14 and to be present wherever necessary; their absence from the present description should not detract from its generality.

The circumference of cylinder 10 is exactly 2P, i.e. twice the impression pitch. Just above, and just below, cylinder 10 and in contact therewith are two blanket cylinders 15 and 16 of conventional design, each having the same circumference as cylinder 10, and driven by a gear train (not shown) so as to rotate synchronously therewith and without slippage. Just above and below blanket cylinders 15 and 16, respectively, and in contact therewith, are corresponding impression cylinders 17 and 18. The central line of contact between a blanket cylinder and a corresponding impression cylinder defines an impression station. There are thus defined an upper impression station 23 and a lower impression station 24.

In proximity to surface 12 of printing cylinder 10 are also two inking systems 21 and 22, disposed at diametrically opposite positions around cylinder 10. The inking systems may be of any conventional type, consistent with the type of the lithographic printing form utilized (which in the preferred embodiment is a waterless type). It is noted that in the case that conventional lithographic printing forms are used, there will, additionally, be a fountain system disposed in association with each inking system; the absence of such fountain systems from the present description should not detract from its generality. Each of the inking systems 21 and 22 also has a mechanism that switchably puts it in, or out of, contact with cylinder 10. Both inking systems are supplied with ink of the same type and color.

The web to be imprinted 20, which preferably is symmetrical with respect to its two faces (that is, both faces have identical mechanical and optical properties), is threaded first between blanket cylinder 15 and impression cylinder 17 (at upper impression station 23) and then between blanket cylinder 16 and impression cylinder 18 (lower impression station 24). Between the two impression stations, web 20 undergoes an inversion, by means of a web inverter 30. As a result, the face of the web that is in contact with blanket cylinder 15 is later in contact with impression cylinder 18 and vice versa, the face of the web that is in contact with impression cylinder 17 is later in contact with blanket cylinder 16. The length of web 20 between the two impression stations is adjusted to be exactly an even multiple of P.

It will be appreciated that, although impression stations 23 and 24, as well as the axes of blanket cylinders 15 and 16, are shown all positioned on a plane that includes the axis of printing cylinder 10, this is not a requirement and each impression station may assume any convenient position around the respective blanket cylinder and each blanket cylinder may assume any convenient position around the printing cylinder. In this case, the length of web between the two impression stations may generally need to be different from an even multiple of P in order to achieve overlap of recto and verso images (as will be explained herebelow).

Web inverter 30 is similar to such devices known in the art (and used, for example, to convert a simplex press to a duplex press by inverting the web between a pair of conventional simplex printing units); particular configurations are disclosed in U.S. Pat. Nos. 4,610,198 and 5,467,179. In the preferred embodiment of the present invention it takes on a special configuration, such that accepts the web directly from the first impression station and delivers it directly into the second impression station. It preferably consists of an assembly of five rollers 32, 33, 34, 35, 36, of which rollers 33 and 35 are oriented at 45 degrees with respect to the path of the web.

Operation of the DDWOP according to the present invention will now be explained with reference to FIGS. 2A and 2B:

For recording a new inking image, inking systems 21 and 22 are switched out of contact with cylinder 10. Recording head 14 is activated and supplied with a stream of signals that alternatingly correspond to the recto—and verso images, while cylinder 10 rotates at the appropriate speed. The surface 12 of cylinder 10 is virtually divided, in a circumferential direction, into two equal halves, marked in FIGS. 2 by F and R, respectively. The signals for the two images are timed so that the signals for the recto image affect RH 14 while the F half of surface 12 passes under it and the signals for the verso image affect RH 14 while the R half of surface 12 passes under it. In one practical configuration of the preferred embodiment, the effective extent of RH 14 in the axial direction is much shorter than cylinder 10 and thus records over only a circumferential-strip-shaped segment of surface 12 during one revolution of cylinder 10. For the next revolution, RH 14 is moved to another position, such that the next contiguous strip segment will be recorded, etc. In such a configuration, the signals for the two images will appear alternatingly once per revolution of cylinder 10. The final result is an inking image corresponding to the recto image on the F half of surface 12 and an inking image corresponding to the verso image on the R half of surface 12. It is noted that a single recording head has been used to thus record both images on the printing cylinder.

For printing, inking systems 21 and 22 are switched into contact with surface 12 and activated (as are also any auxiliary systems, if present). Cylinders 10, 15 and 16 are driven to rotate, each in the direction indicated in FIG. 2B by arrows, and, as a result, also web 20 is driven to move forward, in a direction indicated by arrows. Ink from inking system 21 adheres imagewise to surface 12. The resultant inked version of both images is then transferred to blanket cylinder 15, whence it is transferred to the first (here, lower) face of web 20, at impression station 23, while the web is pressed against impression cylinder 17. Since printing cylinder 10 carries both recto and verso images, both images will thus be continuously imprinted on the first face of the web in successive impressions, alternating between a recto image and a verso image. Meanwhile, ink from inking system 22 is similarly transferred image-wise, by means of blanket cylinder 16, to the second (here, upper) face of web 20, at impression station 24, while the web is pressed against impression cylinder 18, resulting in alternating impressions of the recto and verso images also thereon. The effect is illustrated in FIG. 2A by the images of the letters F and R appearing along the web in correct orientations; where hidden from view they appear in dashed outlines.

It is noted that both faces of the web are thus simultaneously imprinted with the recto and verso images, and that thus a duplex printing operation is effected. It will be observed that in the preferred embodiment, since the length of the web between the first impression station and the second impression station is an even multiple of P, each impression of the verso image on one face of the web will be exactly opposite (i.e. will exactly underlie, or overlap) an impression of the recto image on the other face of the web, and vice versa.

Preferably, web 20 is subsequently cut, by means of a sheeter (not shown), into sheets of length P. It is noted that, if the web is indeed symmetrical with respect to its faces, all sheets will be identical. The only difference between the resulting sheets and those that would have been produced by a conventionally configured duplex DOP is that the sheets resulting from the press of the present invention emerge from the sheeter alternatingly oriented (i.e. alternating between recto image up and recto image down). This condition can be mended by adding to the sheeter, at its output port, an inverting mechanism, such that will invert every other sheet. Alternatively, the sheets coming out of the sheeter may be put through a decoltator, so that they are alternatingly fed to two stacks; each such stack will then have all sheets homogeneously oriented.

It is noted that a single printing cylinder (albeit of twice the normal diameter) is used in the press described hereabove to print both faces of the web—in contrast to the two printing cylinders required (per color) in a conventional duplex press (and a similarly configured DDWOP). This may have an economical benefit, in addition to the benefit due to the single RH (which is the primary rationale for the present invention).

Figure 3A:
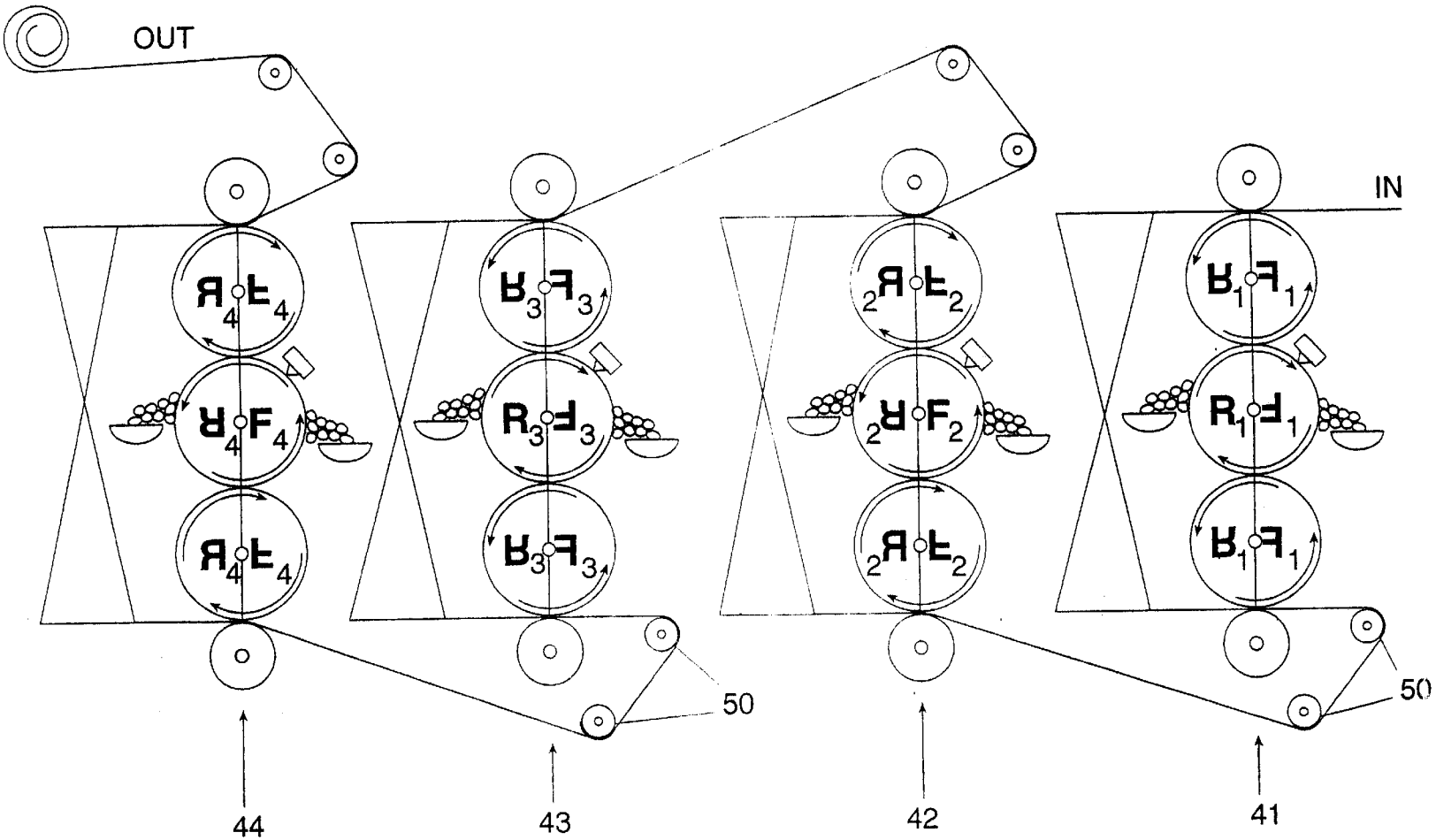
FIG. 3A and FIG. 3B are schematic cross-sectional views of two configurations of a multi-color digital duplex web offset press according the present invention.
Figure 3B:
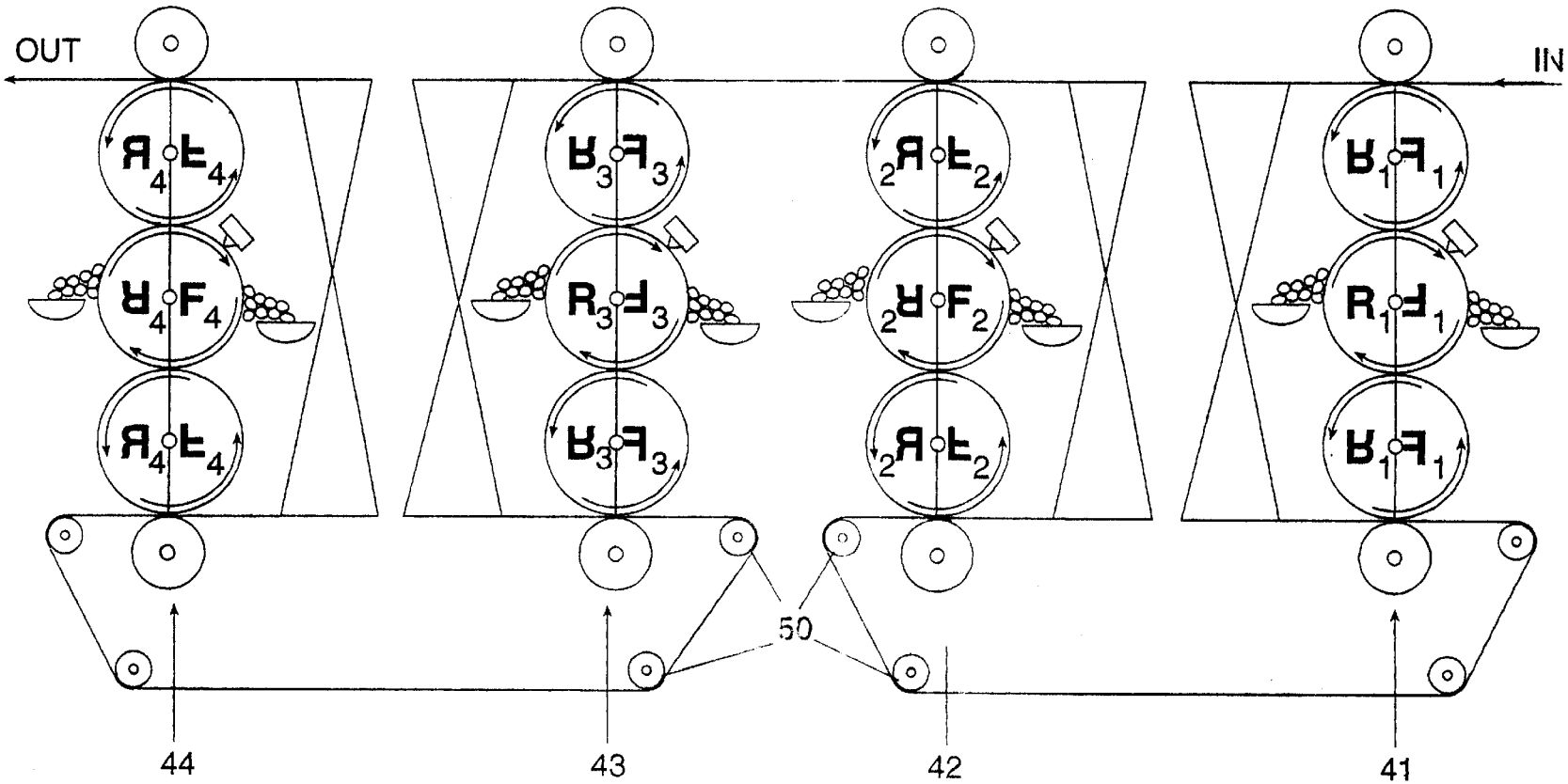

A possible configuration of a full four-color press according to the present invention is shown in FIG. 3A. As has been pointed out hereabove, the press of FIGS. 2, described as a single color web duplex press, can also be regarded as a one color section of a multi-color web duplex press, in which such sections, or towers, as they may also be called, follow each other in the path of the web. The press schematically illustrated in FIG. 3A consists of four such sections, or towers, each section printing in ink of one of the process colors (cyan, magenta, yellow and black) and each being aided by a web inverter 30. The first tower 41 and the third tower 43 are identical to the press of FIGS. 2. The second and fourth towers, 42 and 44, are similar, except that the web runs generally upwards; that is, the web is first imprinted between cylinders 16 and 18 and then, after inversion—between cylinders 15 and 17. In the configuration shown, towers 42 and 44 also differ from towers 41 an 43 in that corresponding cylinders rotate in opposite directions; however, by using a different arrangement of transport rollers 50 and alternating the relative position of web inverters 30, as illustrated in FIG. 3B, all towers may have identically rotating cylinders. In a third possible configuration (not shown), all towers, including the inverters, are identical and the web is routed from the bottom of one tower to the top of the next tower.

It will be appreciated that yet other configurations of multi-color web presses, using sections similar to the basic tower described hereabove, are possible. It is noted that the term color hereabove means ink color and may refer, more generally, to ink type; thus each press section in the above configurations prints with one ink type.

It will be appreciated that the configurations of a digital web duplex press according to the present invention, as described hereabove, though with obvious modifications, are also advantageously applicable to presses based on printing methods other than offset lithography, such as gravure, flexography, rotary screen and stencil printing. It is, furthermore, noted that the configurations of the present invention, are applicable also to conventional web duplex printing, in any method, that is—to presses lacking recording heads and using printing forms that have been prepared off the press. The additional advantage of the configurations of the present invention, common to all such presses, is that only one printing cylinder is required per color, versus the two printing cylinders required in a duplex press of conventional configurations.

While the invention has been described with respect to a limited number of embodiments, it will be appreciated that many variations, modifications and other applications of the invention may be made.

I claim:

1. A digital web printing press section for multiply printing a recto and verso image on both faces of a medium with one type of ink comprising:

a digital recording head, a cylindrical printing form, which is virtually divided into two semi-cylindrical circumferential halves, one half to carry an inking image corresponding to the recto image and the other half to carry an inking image corresponding to the verso image, said cylindrical printing form operatively coupled with said digital recording head and rotatable mounted in said printing press section for said digital recording head to record said recto and verso images on said cylindrical printing form, a first and a second impression station associated with said cylindrical printing form, each operative to repeatedly imprint on the face of the medium with an inked version of both of said recto and verso images carried by said cylindrical printing form, a medium inverter, and means for transporting the medium, in sequence, through said first impression station, said medium inverter and said second impression station, so that a first face of the medium is imprinted at said first impression station and the second face of the medium is imprinted at the second impression station.

2. The printing press section of claim 1, whereby the images imprinted on respective faces of the medium are positioned so that generally each recto image on any one face is in essential overlap with a verso image on the other face.

3. The printing press section of claim 1, whereby the medium is formed as a web and wherein said medium inverter is a web inverter.

4. The printing press section of claim 1, whereby the printing method is either gravure or flexography or rotary screen or stencil, and wherein each of said impression stations includes an impression cylinder in pressing contact with said cylindrical printing form.

5. The printing press section of claim 1, whereby the printing method is offset lithography and further comprising, in association with each of said impression stations, an inking system and a blanket cylinder, in contact with said cylindrical printing form.

6. The press of claim 1, wherein said cylindrical printing form is of a diameter 2P, such that each circumferential half is of an arc length P, and said length P corresponds to the length of the portion of the medium on which one of said recto and verso images are alternately imprinted.

7. A multi-color digital web printing press section for multiply printing a recto and verso image on both faces of a medium, comprising a plurality of sections in tandem, each of said sections operative to print on the medium with one type of ink, comprising:

a digital recording head, a cylindrical printing form, which is virtually divided into two semi-cylindrical circumferential halves, one half to carry an inking image corresponding to the recto image and the other half to carry an inking image corresponding to the verso image, said cylindrical printing form operatively coupled with said digital recording head and rotatably mounted in said printing press section for said digital recording head to record said recto and verso images on said cylindrical printing form, a first and a second impression station associated with said cylindrical printing form, operative to repeatedly imprint on the face of the medium with an inked version of both of said recto and verso images carried by said cylindrical printing form, a medium inverter, and means for transporting the medium, in sequence, through said first impression station, said medium inverter and said second impression station, so that a first face of the medium is imprinted at said first impression station and the second face of the medium is imprinted at the second impression station.

8. The printing press of claim 7, whereby the images imprinted on respective faces of the medium are positioned so that generally each recto image on any one face is in essential overlap with a verso image on the other face.

9. The printing press of claim 7, whereby the medium is formed as a web and wherein said medium inverter is a web inverter and further comprising means for transporting the web from said second impression station of any, but the last one, of said sections to said first impression station of the next one of said sections.

10. The printing press of claim 7, whereby the printing method is either gravure or flexography or rotary screen or stencil, and wherein each of said impression stations includes an impression cylinder in pressing contact with said cylindrical printing form.

11. The printing press of claim 7, whereby the printing method is offset lithography and further comprising, in association with each of said impression stations, an inking system and a blanket cylinder, in contact with said cylindrical printing form.

12. The press of claim 7, wherein said cylindrical printing form is of a diameter 2P, such that each circumferential half is of an arc length P, and said length P corresponds to the length of the of the portion of the medium on which one of said recto and verso images are alternately imprinted.

13. A digital duplex web offset lithographic press, for multiply printing a recto and a verso image, alternateingly, onto each of the two faces of a web formed printing medium, comprising one or more sections in tandem, each of said sections operative to print on the medium with one type of ink, comprising:

a digital recording head, a cylindrical printing form, which is virtually divided into two semi-cylindrical halves, one half to carry an inking image corresponding to the recto image and the other half to carry an inking image corresponding to the verso image, said cylindrical printing form operatively coupled with said digital recording head and rotatably mounted in said printing press section for said digital recording head to record said recto and verso images on said cylindrical printing form, a first and a second inking system in contact with said cylindrical printing form, a first and a second blanket cylinder, associated with said, cylindrical printing form, each of said first and second blanket cylinders oppositely disposed with respect to said cylindrical printing form and operative to repeatedly imprint on the face of the medium, an inked version of both images carried by said cylindrical printing form, said and adapted for contact with said cylindrical printing form, a first and second impression cylinder, in pressing contact with said first and second blanket cylinder, respectively, over a respective one of said two contact areas, said contact areas forming a first and second impression station respectively, a web inverter, and means for transporting the medium, in sequence, through said first impression station, said medium inverter and said second impression station, so that a first face of the medium is imprinted at said first impression station and the second face of the medium is imprinted at the second impression station; and said transporting means additionally configured for transporting the medium from said second impression station to any but the last one, of said sections to said first impression station of the next one of said sections.

14. The press of claim 13, whereby the images imprinted on respective faces of the medium are positioned so that generally each recto image on any one face is in essential overlap with a verso image on the other face.

15. The press of claim 13, wherein said cylindrical printing form is of a diameter 2P, such that each circumferential half is of an arc length P, and said length P corresponds to the length of the portion of the medium on which one of said recto and verso images are alternately imprinted.

* * * * *